US008919421B2

(12) United States Patent
Frohn et al.

(10) Patent No.: US 8,919,421 B2
(45) Date of Patent: Dec. 30, 2014

(54) CATALYSTS COMPRISING METHANE SULFONIC ACID FOR THE ACID HARDENING METHOD

(75) Inventors: Marcus Frohn, Dormagen (DE); Diether Koch, Mettmann (DE); Antoni Gieniec, Hilden (DE)

(73) Assignee: ASK Chemicals GmbH (DE)

( * ) Notice: Subject to any disclaimer, the term of this patent is extended or adjusted under 35 U.S.C. 154(b) by 0 days.

(21) Appl. No.: 12/993,994

(22) PCT Filed: May 22, 2009

(86) PCT No.: PCT/EP2009/003643
§ 371 (c)(1),
(2), (4) Date: Nov. 22, 2010

(87) PCT Pub. No.: WO2009/141158
PCT Pub. Date: Nov. 26, 2009

(65) Prior Publication Data

US 2011/0073269 A1 Mar. 31, 2011

(30) Foreign Application Priority Data

May 23, 2008 (DE) ..... 10 2008 024 727

(51) Int. Cl.
*B22C 1/22* (2006.01)
*B22C 9/02* (2006.01)

(52) U.S. Cl.
CPC ..... *B22C 1/224* (2013.01); *B22C 1/2253* (2013.01)
USPC ..... 164/23; 164/526; 523/144; 523/145

(58) Field of Classification Search
CPC ..... B22C 1/22; B22C 1/224; B22C 1/2253
USPC ..... 164/16, 23, 525, 526; 523/139, 144, 523/145, 146
See application file for complete search history.

(56) References Cited

U.S. PATENT DOCUMENTS

| | | | |
|---|---|---|---|
| 4,478,962 | A | 10/1984 | Woodson |
| 5,248,707 | A | 9/1993 | Gerber |

FOREIGN PATENT DOCUMENTS

| | | | |
|---|---|---|---|
| EP | 0 698 432 | A1 | 2/1996 |
| EP | 1 531 018 | A1 | 5/2005 |
| JP | 55-86642 | A | 6/1980 |
| JP | 57-72750 | A | 5/1982 |
| JP | 9-234540 | | 9/1997 |
| WO | WO 97/31732 | A1 * | 9/1997 |
| WO | WO 2006/044431 | A2 | 4/2006 |

OTHER PUBLICATIONS

International Search Report, completed on Aug. 26, 2009, for corresponding International Application No. PCT/EP2009/003643 (English translation).
International Preliminary Report on Patentability with the Written Opinion, issued on Dec. 6, 2010, for corresponding International Application No. PCT/EP2009/003643 (English translation).
Japanese Office Action Notification of Reasons for Rejection dated Mar. 5, 2013 corresponding to Japanese Application No. 2011-509899.
Chinese Second Office Action dated Apr. 12, 2013 corresponding to Chinese Application No. 200980124623.7.

* cited by examiner

*Primary Examiner* — Kevin P Kerns
(74) *Attorney, Agent, or Firm* — Locke Lord LLP; Alan B. Clement; Peter J. Fallon

(57) ABSTRACT

A method for producing cores and molds for the foundry industry utilizing a flowable fire-resistant primary molding material. The method includes an acid applied to the flowable fire resistant primary molding material to obtain an acid-coated fire-resistant primary molding material. A binder that can be cured by acid is applied to the acid-coated fire resistant primary molding material to obtain a fire-resistant primary molding material coated with a binder. The fire-resistant primary molding material coated with a binder is then molded into a molded body, and-the molded body is cured. The acid used is a mixture of methane sulfonic acid and at least one sulfur-free acid. The casting molds can be produced having reduced emission of harmful compounds during casting.

4 Claims, No Drawings

CATALYSTS COMPRISING METHANE SULFONIC ACID FOR THE ACID HARDENING METHOD

CROSS-REFERENCE TO RELATED APPLICATIONS

This application is the U.S. national phase of International Application No. PCT/EP2009/003643, filed May 22, 2009, which designated the U.S. and claims priority to German Application No. DE 10 2008 024 727.8, filed May 23, 2008, the entire contents of each of which are hereby incorporated by reference.

BACKGROUND OF THE INVENTION (1) Field of the Invention

The invention relates to a method for producing cores and moulds for the foundry industry, and a mould material mixture such as is used in the method.

(2) Description of Related Art

Casting moulds for producing metal components consist of parts called cores and moulds. The casting mould is essentially a negative representation of the casting to be produced, and cores are used to create cavities within the casting while the moulds reflect the external delineation. In this context, different cores and moulds are subject to different requirements. Moulds possess a relatively large surface area for dissipating gases that are formed by the action of the hot metal during casting. Cores usually have a very small surface area by which these gases can be dissipated. Therefore, if an excessive quantity of gas is generated, there is a danger that gas will escape from the core and into the liquid metal, resulting in casting defects there. Accordingly, the interior cavities are often reflected by cores that have been hardened using a cold box binders, that is to say a polyurethane-based binder, while the outer contour of the of the casting is represented by less expensive moulds, such as a basic sand mould, a mould that is bonded using a furan resin or a phenolic resin, or by a permanent mould.

Casting moulds consists of a fire-resistant material, for example quartz sand, the grains of which are bonded with a suitable bonding material after demoulding to lend adequate mechanical strength to the casting mould. Accordingly, casting moulds are produced using a fire-resistant primary moulding material that is reacted with a suitable binder. The mould material mixture obtained from the primary moulding material and the binder is preferably flowable so that it can be introduced into a suitable hollow mould and compacted therein. The binder ensures that the particles of the primary moulding material are bonded together firmly, so that the casting mould has the required mechanical stability.

Either organic or inorganic binders may be used in the production of casting moulds, and such binders may be cured by cold or hot method. In this context, methods that are carried out essentially at room temperature, without heating the mould material mixture, are called cold methods. Curing is usually effected by a chemical reaction, which may be initiated for example by passing a gas-phase catalyst through the mould material mixture to be cured, or by adding a liquid catalyst to the mould material mixture. In hot methods, the mould material mixture is heated to temperature that is high enough for example to drive out the solvent contained in the binder, or to initiate a chemical reaction in which the binder is cured by crosslinking.

At present, a wide variety of organic binders is used to produce casting moulds, including for example polyurethane, furan resin, or epoxy acrylate binders, with which the binder is cured by addition of a catalyst.

The selection of a suitable binder is determined by the shape and size of the casting item to be produced, the production conditions, and the material that is used for the casting. Thus for example, polyurethane binders are frequently used in the production of large numbers of small casting items, because they allow of rapid cycle times and thus also volume production.

Methods in which the mould material mixture is cured by heat or the subsequent addition of a catalyst have the advantage that processing of the mould material mixture is not subject to any time restrictions. The mould material mixture may be produced initially in relatively large quantities, which are then processed within a protracted period of time, usually several hours. The mould material mixture is not cured until after the moulding operation, though when curing does take place, the reaction should be a rapid as possible. The casting mould may be removed from the moulding tool immediately after curing so that short cycle times may be achieved. However, in order to ensure that the casting mould has good stability, curing of the mould material mixture in the casting mould must take place evenly. If the mould material mixture is to be cured by the subsequent addition of a catalyst, the gas-phase catalyst is passed through the casting mould after the moulding operation. To this end, the gas-phase catalyst is fed through the casting mould. The mould material mixture is cured directly upon contact with the catalyst, and may therefore be removed from the moulding tool very quickly. The larger the casting mould is, the more difficult it becomes to supply a sufficient quantity of catalyst to all sections of the casting mould to ensure that the mould material mixture will be cured. Gas exposure times become longer, and it is still possible for there to be sections in the casting mould that receive inadequate exposure to the gas-phase catalyst, or even none at all. Consequently, the quantity of catalyst increases significantly as the casting mould becomes larger.

Similar difficulties are encountered with hot curing methods. In this case, all sections of the casting mould must be heated to a sufficiently high temperature. As the casting mould increases in size, the times for which it must be heated to a specified temperature to enable curing become longer. Only then can it be ensured that the interior of the casting mould will have the requisite strength as well. Furthermore, as the size of the casting mould increases, the equipment that must be used for curing becomes very complex.

Consequently, when casting moulds are produced for large cast items, such as engine blocks for marine diesels or large machine parts such as rotor hubs for wind turbines, the binders uses are mostly of the no-bake type. In the no-bake method, the fire-resistant primary moulding material is initially covered with a catalyst. Then, the binder is added and by mixing is spread evenly onto grains of the fire-resistant mould material mixture that has previously been coated with the catalyst. The mould material mixture may then be shaped in the form of a mould. Since the binder and catalyst are both distributed evenly throughout the mould material mixture, curing takes place with a high degree of uniformity even for large moulds.

Since the catalyst is added to the mould material mixture before the moulding operation, the mould material mixture begins curing as soon as it has been produced. In order to achieve a processing time that is suitable for industrial application, one requirement is that the components of the mould material mixture must be adjusted to each other very precisely. This enables the reaction speed for a given quantity of binder and fire-resistant primary moulding material to be controlled by changing the type and quantity of the catalyst, or even by adding retarding components. The mould material mixture must also be processed under very closely controlled conditions, because the rate of curing is affected by the temperature of the mould material mixture, for example.

The classic no-bake binders are based on furan resins and phenolic resins. They are available commercially as two-component systems, in which one component is a reactive furan resin or phenolic resin and the other component comprises an acid that functions as the catalyst for curing the reactive resin component.

Furan and phenolic resins have very good dissociation properties during casting. The furan or phenolic resin is broken down by the heat of the molten metal, and the casting mould loses its stability. As a result, it is very easy to pour the cores out of the cavities after casting, after shaking the cast item if necessary.

The essential component of the reactive furan resins that represent the primary component of "furan no-bake binders" is furfuryl alcohol. With an acid catalyst, furfuryl alcohol is able to react with itself to form a polymer. In general, the furfuryl alcohol used to produce furan no-bake binders is not pure, other compounds are added to the furfuryl alcohol and are incorporated in the resin by polymerisation. Examples of such compounds are aldehydes such as formaldehyde or furfural, ketones such as acetone, phenols, urea, or also polyols such as sugar alcohols or ethylene glycol. Still other components can also be added to the resins to modify the properties of the resin, such as its elasticity. For example, melamine may be added to bind free formaldehyde.

Furan no-bake binders are usually obtained by a process in which precondensates containing furfuryl are first created for example from urea, formaldehyde and furfuryl alcohol in an acidic environment. The reaction conditions are selected such that only limited polymerisation of the furfuryl alcohol takes place. These precondensates are then diluted with furfuryl alcohol. Resols can also be used to produce furan no-bake binders. Resols are obtained by polymerising mixtures of phenol and formaldehyde. These resols are then diluted with furfuryl alcohol.

The second component of furan no-bake binders is an acid. This acid not only neutralised alkaline components that are contained in the fire-resistant primary moulding material, it also catalyses crosslinking of the reactive furan resin.

The acids most often used are aromatic sulfonic acids, and in some specific cases phosphoric acid or sulphuric acid as well. Phosphoric acid is used in a concentrated form, that is to say in concentrations greater than 75%. However, it is only suitable for the catalytic curing of furan resins that have a relatively high urea component. The nitrogen content in resins of this type is greater than 2.0% by weight. As a relatively strong acid, sulphuric acid can be added to weaker acids as a starter for curing furan resins. However, an odour characteristic of sulphur compounds is emitted during casting. There is also a danger that the casting material may absorb some of the sulphur, which would affect its properties of the material.

The compounds most commonly used as catalysts are sulfonic acids. Toluenesulfonic acid, xylenesulfonic acid, and benzenesulfonic acid are used particularly preferably because they are readily available and strongly acidic.

The choice of catalyst has a considerable effect on the properties of the binder. For example, the rate of curing can be adjusted by the quantity, and also by the strength of the acid. Larger quantities of acid, or stronger acids, both accelerate the curing rate. If too much catalyst is used, however, the furan resin becomes brittle during curing, and this in turn is detrimental to the strength of the casting mould. If too little catalyst is used, the resin is not cured completely, or curing takes a very long time, and this in turn impairs the strength of the casting mould.

When casting moulds are manufactured, most cores are made exclusively from new sand, while reprocessed sand is used for the moulds. Fire-resistant primary moulding materials that have been solidified using furan no-bake binders lend themselves very readily to reprocessing. Processing is carried out either mechanically, by mechanically abrading a shell formed from residual binder, or by heat treating the used sand. With mechanical processing or a combination of mechanical and thermal methods, recovery rates of close to 100% can be achieved.

The second large group of no-bake binders that are curable with acid catalysis are the phenolic resins, and the reactive resin component in these are resols, that is to say phenolic resins that have been manufactured with an excess of formaldehyde. Phenolic resins are markedly less reactive than furan resins, and strong sulfonic acids must be used as catalysts. Phenolic resins have a relatively high viscosity, which increases further if the resin is stored for a protracted period. This viscosity rises significantly, particularly at temperatures below 20° C., which means that the sand must be heated to enable the binder to be spread evenly over the surfaces of the sand grains. After the phenolic no-bake binder has been applied to the fire-resistant primary moulding material, the mould material mixture should be processed as promptly as possible, to avoid having to compensate for loss of quality of the mould material mixture due to premature curing, which in turn may result in a loss of strength in the casting moulds produced from the mould material mixture. When phenolic no-bake binders are used, the flowability of the mould material mixture is usually poor. The mould material mixture must therefore be compacted very thoroughly when producing the casting mould in order to obtain casting moulds that are as strong as possible.

The mould material mixture should be produced and processed at temperatures in the range from 15 to 35° C. If the temperature is too low, the mould material mixture is difficult to process because of the high viscosity of the phenolic no-bake resin. At temperatures above 35° C., the processing time is shortened due to premature curing of the binder.

After the casting, mould material mixtures based on phenolic no-bake binders are also able to be reprocessed, and in this case too mechanical or thermal or combined mechanical and thermal methods may be used.

As was explained previously, the acid that is used as the catalyst in furan and phenolic no-bake methods has a significant effect on the properties of the casting mould. The acid must be strong enough to ensure an adequate reaction rate while the casting mould is curing. The curing process must be easily controllable, so that sufficiently long processing times may be set. This is particularly important when producing casting moulds for very large cast items whose construction takes a relatively long period of time.

In addition, the acid must not become concentrated in the recovered substance when use sands are recovered. If acid is introduced into the mould material mixture via the recovered substances, it shortens the processing time and impairs the strength of the casting mould that is manufactured from the recovered material.

Accordingly, only a small number of acids are suitable for use as catalysts in no-bake methods. If one also takes into account financial considerations, the only acids that are viable for practical purposes are the aromatic sulfonic acids, of which toluenesulfonic acid, xylenesulfonic acid and benzenesulfonic acid are particularly important.

Phosphoric, acid and sulphuric acid are of secondary importance. As was explained previously, phosphoric acid is only suitable for curing certain furan resin qualities. However, phosphoric acid is not at all suitable for curing phenolic resins. A further disadvantage of phosphoric acid is its tendency to accumulate in the recovered material, making it more difficult to use the recovered material again. Using sulphuric acid leads to the emission of sulphur dioxide during both casting and thermal regeneration, a substance that is corrosive, hazardous to health, and foul-smelling.

During casting, the cured binder is designed to break down so that the casting mould loses its stability. The aromatic sulfonic acids used as the catalyst, particularly p-toluenesulfonic acid, benzenesulfonic acid and xylenesulfonic acid, break down under the effects of the heat and the reducing atmosphere created during casting, releasing aromatic pollutants such as benzene, toluene or xylene (BTX) besides sulphur dioxide. A fraction of these byproducts of decay also remains in the used sand and can be released during reprocessing.

Patent No. WO 97/31732 describes a self-curing furan no-bake mould material mixture for producing casting moulds that, in addition to a resin containing furan, contains methane sulfonic acid as the catalytic acid. Methane sulfonic acid may also be used in a mixture with an organic sulfonic acid or an inorganic acid. Examples of organic sulfonic acids include p-toluenesulfonic acid, benzenesulfonic acid and xylenesulfonic acid. An example of an inorganic acid would be sulphuric acid. Methane sulfonic acid has greater acidic strength than p-toluenesulfonic acid, for example. When this acid is used, the furan no-bake binder is then cured correspondingly more quickly, and curing may be achieved within acceptable periods even at low temperatures, that is to say at temperatures below 25° C. However, the use of methane sulfonic acid is associated with considerable difficulties, particularly for producing very large casting moulds, due to its strong reactivity, because it functions as a rapid curing agent, and thus only allows relatively short processing periods. Another disadvantage consists in that the use of methane sulfonic acid or methane sulfonic acid mixed with organic sulfonic acids results in the release of sulphur dioxide during casting.

Particularly because of their carcinogenic effect, extremely low MWC values (MWC=maximum workplace concentration) are imposed on hazardous aromatic substances. The MWC value for benzene is just 3.2 $mg/m^3$, the values for toluene and xylene are 190 $mg/m^3$ and 440 $mg/mm^3$ respectively. This has now become a problem in foundries because highly sophisticated extraction plants and filters are needed to ensure compliance with these limit values.

BRIEF SUMMARY OF THE INVENTION

This object as well as several advantageous embodiments are described in the present claims.

This object is solved with a method having the features of claim 1. Advantageous embodiments are described in the dependent claims.

Surprisingly, it was found when mixtures of methane sulfonic acid with at least one other sulphur-free acid are used as the catalyst for curing furan and phenolic no-bake binders, firstly in general that the resin contained in the binder is cured at all, since the acidic strength of the sulphur-free acid is too low in its own right to function as a catalyst for crosslinking furan or phenolic resins, and secondly that the curing time may be controlled so as to enable processing times to be programmed that are long enough to allow the mould material mixture to be processed even for larger casting moulds. A particular advantage of the method according to the invention consists in the fact that the emission of harmful substances, particularly the emission of sulphur dioxide and toxic aromatic substances such as benzene, toluene or xylene during casting, may be reduced drastically. Consequently, the load of these noxious substances in the used sand may also be reduced.

Accordingly, according to the invention a method is provided for producing cores and moulds for the foundry industry, wherein

- a flowable, fire-resistant primary moulding material is provided;
- an acid is applied to the flowable, fire-resistant primary moulding material, wherein an acid-coated primary moulding material is obtained;
- a binder that is curable with an acid is applied to the acid-coated fire-resistant primary moulding material, wherein a mould material mixture is obtained;
- the mould material mixture is shaped to form a moulding element (=moulded body); and
- the moulding element is cured.

According to the invention, the acid used as the catalyst for curing the resin is a mixture of methane sulfonic acid and at least one further, sulphur-free acid.

DETAILED DESCRIPTION OF THE INVENTION

A large fraction of the substances used in the method according to the invention is already in use in mould material mixtures for the production of casting moulds, which means that it is possible to draw on the knowledge of one skilled in the art in this regard.

Thus for example, all fire-resistant substances that are commonly used to produce moulding elements for the foundry industry may be used as the fire-resistant primary moulding material. Examples of suitable fire-resistant primary moulding materials are quartz sand, zircon sand, olivine sand, aluminium silicate sand, and chrome ore sand, also mixtures thereof. Preferably, quartz sand is used. The particles of the fire-resistant primary moulding material should be of such a size that the porosity of the moulding element produced from the mould material mixture is sufficient to enable volatile compounds to escape during casting. Preferably, at least 70% by weight, particularly preferably at least 80% by weight of the fire-resistant primary moulding material has a particle size ≤290 μm. The average particle size of the fire-resistant primary moulding material should preferably be between 100 and 350 μm. The particle size may be determined for example by sieve analysis. The fire-resistant primary moulding material should be available in flowable form, so that the catalyst and the acid-curable binder may be readily coated on the grains of the fire-resistant primary moulding material, in a mixer for example.

Preferably, regenerated used sands are used as the fire-resistant primary moulding material. Larger accretions are removed from the used sand, and the used sand is separated into its constituent grains if necessary. Following mechanical and/or thermal treatment, the used sands are dedusted and may then be used again. The pH balance of the regenerated used sand is preferably tested before it is used again. Particularly during thermal regeneration, byproducts contained in the sand such as carbonates can be converted into the corresponding oxides, which then react as alkalis and neutralise the acid that has been added to the binder as the catalyst. Equally, in a mechanical regeneration for example, acid may be left in the used sand but should be taken into account when the binder is produced so as not to shorten the processing time for the mould material mixture.

The fire-resistant primary moulding material should preferably be dry, because the curing reaction is retarded by water. The fire-resistant primary moulding material preferably contains less than 1% by weight water. To prevent the binder from curing prematurely, the fire-resistant primary moulding material should not be too hot. The fire-resistant primary moulding material should preferably be at a temperature in the range from 20 to 35° C. The fire-resistant primary moulding material may be heated or cooled as necessary.

An acid is then applied to the flowable fire-resistant material, and an acid-coated fire-resistant primary moulding material is thus obtained. The acid is applied to the fire-resistant primary moulding material by conventional means, for example by spraying the acid onto the fire-resistant primary moulding material. The quantity of acid is preferably selected in the range from 5 to 45% by weight, particularly preferably in the range from 20 to 30% by weight relative to the weight of the binder and calculated as pure acid, that is to say without considering any solvent used. If the acid is not already present in liquid form, and its viscosity is not already low enough to enable it to be applied to the grains of the fire-resistant primary moulding material in the form of a thin film, the acid is dissolved in a suitable solvent. Examples of such solvents are water or alcohols or mixtures of water and alcohol. Particularly if water is used, however, the solution is produced in the most concentrated form possible, so that the quantity of water introduced into the binder and thus also the mould material mixture may be minimised. The mixture of fire-resistant primary moulding material and acid is thoroughly homogenised to ensure that the acid is distributed as evenly as possible over the grains.

An acid-curable binder is then applied to the fire-resistant primary moulding material that has already been coated with acid. The quantity of the binder is preferably selected in the range from 0.25 to 5% by weight, particularly preferably in the range from 1 to 3% by weight relative to the fire-resistant primary moulding material and calculated as a component of the resin. In theory, all binders that are curable with acids, particularly such acid-curable binders that are already commonly used for producing mould material mixtures for the foundry industry, may be used as the acid-curable binder. The binder may also contain other conventionally used components besides a crosslinkable resin, for example solvents for adjusting viscosity, or extenders that replace a portion of the crosslinkable resin.

The binder is applied to the fire-resistant primary moulding material that has already been coated with acid, and is spread by moving the mixture so as to form a thin film on the grains of the fire-resistant primary moulding material.

The quantities of binder and acid are selected such that on the one hand the casting mould has sufficient dimensional stability, and on the other hand that the sufficient processing time is allowed for the mould material mixture. For example, a processing time in the range from 5 to 45 minutes is suitable.

The fire-resistant primary moulding material coated with the binder is than formed into a moulding element by conventional methods. For this, the mould material mixture may be introduced into a suitable mould and compacted therein. The moulding element obtained thereby is then allowed to cure.

According to the invention, a mixture of methane sulfonic acid and at least one further sulphur-free acid is used as the catalyst. Use of this mixture helps to reduce both the emissions of aromatic pollutants, particularly BTX, and the emissions of sulphur dioxide during casting. Although the strongly acidic fraction of methane sulfonic acid is reduced, its reactivity is still strong enough to cure the binder within a time period that is useful for industrial applications.

In theory, any acid may be used as the further sulphur-free acid, provided it includes no sulphur-containing groups. Both inorganic and organic acids may be used, wherein good reactivity of the binder system is achieved in particular for organic acids, even though such organic acids usually have a relatively low acid strength.

The fraction of the acid used as the catalyst that is represented by methane sulfonic acid depends on the reactivity of the resin used in the binder, on the at least one sulphur-free acid used in addition to the methane sulfonic acid, and on the quantity of the acid used. In order to minimise the fraction of sulphurous emissions during casting while retaining sufficient reactivity and thus also a sufficiently short curing time, the fraction of methane sulfonic acid in the acid used as the catalyst is preferably selected to be less than 70% by weight, particularly less than 65% by weight, especially less than 60% by weight, and particularly preferably less than 55% by weight. On the other hand, in order to achieve adequate productivity, the fraction of methane sulfonic acid in the acid used as the catalyst is preferably selected to be greater than 20% by weight, particularly greater than 30% by weight, especially greater than 35% by weight, and particularly preferably greater than 40% by weight.

Accordingly, the fraction of sulphur-free acid is preferably selected to be greater than 30% by weight, particularly greater than 35% by weight, especially greater than 40% by weight, and particularly preferably greater than 45% by weight.

Besides the methane sulfonic acid and the sulphur-free acid, the acid used as the catalyst may also comprise a small fraction of a further aromatic sulfonic acid. This fraction is preferably selected to be less than 20% by weight, particularly less than 10% by weight, and especially less than 5% by weight. It is especially preferable if the acid used as the catalyst contains no aromatic sulfonic acid. Examples of aromatic sulfonic acids are toluenesulfonic acid, benzenesulfonic acid and xylenesulfonic acid.

All proportions refer to the respective anhydrous acids.

As was explained previously, in theory any binder that is able to be cured with acid catalysis may be used in the method according to the invention. However, a furan no-bake binder or a phenolic no-bake binder is preferably used as the acid-curable binder.

In theory, any furan resins such as are already used in furan no-bake binder systems may be used as the furan no-bake binder.

The furan resins used in technical furan no-bake binders are usually precondensates or mixtures of furfuryl alcohol with additional monomers or precondensates. The precondensates contained in furan no-bake binders are prepared according to a generally known method.

According to a preferred embodiment, furfuryl alcohol is used in combination with urea and/or formaldehyde or urea/formaldehyde precondensates. Formaldehyde may be used either in the monomer form, for example in the form of a formalin solution, or in for of its polymers, such as trioxane or paraformaldehyde. Other aldehydes or also ketones may be used as well as or instead of formaldehyde. Suitable aldehydes are for example acetaldehyde, propionaldehyde, butyraldehyde, acrolein, crotonaldehyde, benzaldehyde, salicylaldehyde, cinnamic aldehyde, glyoxal and mixtures of these aldehydes. Formaldehyde is preferred, and is used preferably in the form of paraformaldehyde.

All ketones that demonstrate sufficient reactivity may be used as the ketone component. Examples of ketones are methylethyl ketone, methylpropyl ketone and acetone, wherein acetone is used for preference.

The named aldehydes and ketones may be used as individual compounds, or also in combination with each other.

The molar ratio of aldehyde, particularly formaldehyde, and ketone to furfuryl alcohol may be selected within wide ranges. Preferably 0.4 to 4 mol furfuryl alcohol, especially 0.5 to 2 mol furfuryl alcohol may be used per mol aldehyde for producing furan resins.

Furfuryl alcohol, formaldehyde and urea may be heated to boiling, for example after adjusting to a pH value higher than 4.5, to produce the precondensates, wherein water is continuously distilled out of the reaction mixture. The reaction time may be several hours, for example 2 hours. Under these reaction conditions, practically no polymerisation of the furfuryl alcohol takes place at all. However, the furfuryl alcohol is condensed into the resin together with the formaldehyde and the urea.

According to an alternative method, furfuryl alcohol, formaldehyde and urea are reacted at elevated heat and with a pH value significantly below 4.5, for example with a pH value of 2.0, wherein the water formed during condensation may be distilled off under reduced pressure. The reaction product has a relatively high viscosity and is diluted with furfuryl alcohol until the desired viscosity is set, in order to produce the binder.

Hybrid forms of these production methods may also be used.

It is also possible to introduce phenol into the precondensate. For this, the phenol may first be reacted with formaldehyde in an alkaline environment to yield a resol resin. This resol may then be reacted or mixed with furfuryl alcohol or a resin containing a furan group. Such resins comprising furan may for example be removed with the methods described above. Higher phenols, for example resorcin, cresols, or even bisphenol A, may also be used to produce the precondensate. The fraction of phenol or the higher phenols included in the binder is preferably selected to be in the range of up to 45% by weight, particularly up to 20% by weight, particularly preferably up to 10% by weight. According to one embodiment of the invention, the fraction of phenol or of the higher phenols may be selected to be more than 2% by weight, according to another embodiment more than 4% by weight.

It is also possible to use condensates from aldehydes and ketones, which are then mixed with furfuryl alcohol to produce the binder. Such condensates may be produced by reacting aldehydes and ketones in alkaline conditions. Formaldehyde, particularly in the form of paraformaldehyde, is preferably used as the aldehyde. Acetone is preferably used as the ketone. However, other aldehydes and ketones may also be used. The relative molar ratio between aldehyde and ketone preferably selected in the range from 7:1 to 1:1, particularly from 1.2:1 to 3.0:1. Condensation is preferably carried out in alkaline conditions with pH values in the range from 8 to 11.5, preferably 9 to 11. A suitable base is sodium carbonate for example.

The quantity of furfuryl alcohol that is contained in the furan no-bake binder is determined on the one hand by the attempt to keep the fraction as low as possible, for reasons of cost. On the other hand, a high fraction of furfuryl alcohol results in improved stability of the casting mould. If the fraction of furfuryl alcohol in the binder is very high, however, the casting moulds produced are brittle and do not respond well to processing. The fraction of furfuryl alcohol in the binder is preferably selected to be in the range from 30 to 95% by weight, particularly from 50 to 90% by weight, and particularly preferably from 60 to 85% by weight. The fraction of urea and/or formaldehyde in the binder is preferably selected to be in the range from 2 to 70% by weight, particularly from 5 to 45% by weight, and particularly preferably from 15 to 30% by weight. These fractions include both the non-bonded fractions of these compounds in the binder and the fractions that are bonded in the resin.

Further additives may be added to the furan resins, for example ethylene glycol or similar aliphatic polyols, for example sugar alcohols such as sorbitol, which function as extenders and replace a portion of the furfuryl alcohol. If the added component of such extenders is too high, in the most unfavourable case the stability of the casting mould is impaired and reactivity is lowered. The fraction of these extenders in the binder is therefore preferably selected to be less than 25% by weight, particularly less than 15% by weight, and particularly preferably less than 10% by weight. In order to reduce costs without losing undue control over the stability of the casting mould, the fraction of the extenders according one embodiment is selected to be greater than 5% by weight.

The furan no-bake binders may still contain water. However, since water retards curing of the mould material mixture, and water is created as a byproduct of the curing reaction, the fraction of water is preferably kept as low as possible. The fraction of water in the binder is preferably less than 20% by weight, particularly less than 15% by weight. From the financial perspective, a water quantity of more than 5% by weight in the binder is tolerable.

In the method according to the invention, resols are used as the phenolic resins. Resols are mixtures of hydroxymethyl phenols that are linked via methylene and methylene ether bridges and may be obtained by reacting aldehydes and phenols in a molar ratio of 1:<1, if necessary in the presence of a catalyst, for example a basic catalyst. The have a molar weight $M_w$ of ≤10,000 g/mol.

All conventionally used phenols are suitable for producing phenolic resins. Besides unsubstituted phenol, substituted phenols or mixtures thereof may be used. To enable polymerisation, the phenol compounds are unsubstituted either in both ortho-positions or in one ortho- and in the para-position. The remaining ring carbon atoms may be substituted. There a no special restrictions on the selection of the substituent provided the substituent does not hinder the polymerisation of the phenol or the aldehyde. Examples of substituted phenols are alkyl-substituted phenols, alkoxy-substituted phenols, and aryloxy-substituted phenols.

The substituents listed above have for example 1 to 26, preferably 1 to 15 carbon atoms. Examples of suitable phenols are o-Cresol, m-Cresol, p-Cresol, 3,5-Xylene, 3,4-Xylene, 3,4 ,5-Trimethylphenol, 3-Ethylphenol, 3,5-Diethylphenol, p-Butylphenol, 3,5-Dibutylphenol, p -Amylphenol, Cyclohexylphenol, p-Octylphenol,p -Nonylphenol, 3,5-Dicyclohexylphenol, p-Crotylphenol, p -Phenylphenol, 3,5-Dimethoxyphenol and p-Phenoxyphenol .

Particularly preferred is phenol itself. Higher condensed phenols such as bisphenol A are also suitable. Polyvalent phenols having more than one phenolic hydroxyl group are also suitable. Preferred polyvalent phenols have 2 to 4 phenolic hydroxyl groups. Special examples of suitable polyvalent phenols are Brenzcatechin, Resorcin, Hydrochmon, Pyrogallol, Fluoroglycin, 2,5-Dimethylresorcin, 4,5-Dimethylresorcin, 5-Methylresorcin, or 5-Ethylresorcin.

Mixtures of various monovalent and polyvalent and/or substituted and/or condensed phenol components may also be used to produce the polyol component.

In one embodiment, phenols having the following general formula I:

Formula I

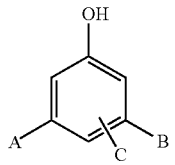

are used to produce the phenol resin component, wherein A, B and C are independent of each other and are selected from a hydrogen atom, a branched or unbranched alkyl radical that may have for example 1 to 26, preferably 1 to 15 carbon atoms, a branched or unbranched alkoxy radical that may have for example 1 to 26, preferably 1 to 15 carbon atoms, a branched or unbranched alkenoxy radical that may have for example 1 to 26, preferably 1 to 15 carbon atoms, an aryl- or alkylaryl radical, such as for bisphenyls example.

In theory, the same aldehydes as are used to produce the. furan resin component in furan no-bake binders are also suitable for use as the aldehyde for producing the phenolic resin component. According to one embodiment, suitable aldehydes have formula:

R—CHO, wherein R is a hydrogen atom or a carbon atom radical having preferably 1 to 8, particularly 1 to 3 carbon atoms. Special examples are formaldehyde, acetaldehyde, propionaldehyde, furfurylaldehyde and benzaldehyde. Formaldehyde is used particularly preferably, either in its aqueous form, as para-formaldehyde or trioxane.

To obtain phenolic resins, aldehyde having a molar number at least equivalent to the molar number of the phenol component should be used. The molar ratio between aldehyde and phenol is preferably 1:1.0 to 2.5:1, particularly preferably 1.1:1 to 2.2:1, especially preferably 1.2:1 to 2.0:1.

The bases used to produce the resols may include for example sodium hydroxide, ammonia, sodium carbonate, calcium, magnesium hydroxide and barium hydroxide, or also tertiary amines. The resols may also be modified by additional compounds, for example nitrogen-containing compounds such as urea. The resols are preferably reacted with furfuryl alcohol to produce the binder.

The binders may also contain other usual additives, such as silanes as adhesion promoters. Suitable silanes are for example aminosilanes, epoxysilanes, mercaptosilanes, hydroxysilanes and ureiodosilanes, such as γ-Hydroxypropyl trimethoxysilane, γ-Aminopropyl trimethoxysilane, 3-Ureidopropyl triethoxysilane, γ-Mercaptopropyl trimethoxysilane, γ-Glycidoxypropyl trimethoxysilane, β-(3,4-Epoxycyclohexyl)trimethoxysilane, N-β-(aminoethyl)-γ-aminopropyl trimethoxysilane.

If such a silane is used, it is added to the binder in a proportion of 0.1 to 3% by weight, preferably 0.1 to 1% by weight.

The binders may also contain activators, which accelerate the curing of the binder. Such activators are for example resorcin, bisphenol A. Mixtures that remain in the sludge after resorcin or bisphenol A have been distilled may also be used. These mixtures contain oligomers of resorcin or bisphenol A, for example dimers, trimers, or even polymers.

Polyols may also be added to the binder, including polyether polyols or polyester polyols. Polyester polyols may be produced for example by reacting a dicarboxylic acid with a glycol. Suitable dicarboxylic acids are for example adipic acid or oxalic acid. Suitable glycols are for example ethylene glycol, propylene glycol or diethylene glycol. The molecular weight of these compounds is preferably the range from 300 to 800. Polyether polyols are available commercially. They can be produced by reacting an alkylene oxide with a glycol. Suitable alkylene oxides are for example ethylene oxide, propylene oxide or butylenes oxide. Example of suitable glycols are ethylene glycol, diethylene glycol and propylene glycol.

In order to adjust the viscosity, the binder may also contain solvents. A suitable solvent, for example, is water, or alcohols such as methanol or ethanol for example.

The binder may also contain plasticisers, for example monoethylene glycol or diisobutyl phthalate.

The mould material mixture may also contain other usual components in addition to the fire-resistant primary moulding material, the catalyst and the binder. Examples of such additional components are iron oxide, ground flax fibres, wood flour granules, ground coal or clay.

For preference, organic acids are used as the sulphur-free acids. Organic acids can be separated readily during regeneration of the used sand, so that they do not accumulate in the regenerated used sand. In thermal regeneration organic acids decompose to form harmless compounds, ultimately water and carbon dioxide, which means that when organic acids are used no special measures have to be implemented, for example to purify the exhaust gas from the regeneration process. The term organic acids is used for carbon-based compounds that include at least one carboxyl group. Besides the at least one carboxyl group, the organic acids may also include other functional groups, for example hydroxy groups, aldehyde groups, or even double bonds. The organic acids preferably comprise 1 to 10 carbon atoms, particularly preferably 2 to 8 carbon atoms.

Preferably, saturated carboxylic acids are used because they are readily available, and are highly stable, which means that they can also be stored for prolonged periods without any loss of quality.

The preferred sulphur-free acids for these purposes are those organic acids that have a high acid strength. Besides the at least one carboxyl group, the organic acid preferably comprises at least one more electron-withdrawing group.

According to a preferred embodiment, the at least one more electron-withdrawing group is selected from the group of carboxyl group, hydroxy group, aldehyde group. Dicarboxylic acids, tricarboxylic acids, or hydroxycarboxylic acids are used particularly preferably.

According to one embodiment, the organic acid is selected from the group of citric acid, lactic acid, glycolic acid, glyoxylic acid, malic acid, oxalic acid. These acids may be used individually or in combination with each other.

The at least one additional acid, particularly organic acid, preferably has a $pK_a$ value lower than 4.5, particularly lower than 4.0 . According to one embodiment, the at least one additional acid, particularly organic acid has a $pK_a$ value higher than 1.0, according to a further embodiment a $pK_a$ value higher than 2. According to a further embodiment, the at least one additional acid, particularly organic acid, has a $pK_a$ value in the range from 3 to 4.

In order to achieve even distribution of the acid on the grains of the fire-resistant primary moulding material, the acid is preferably added in the form of a solution. The preferred solvent is water. As was explained earlier, since water slows the curing process of the moulding material mixture, a concentrated solution of the acid is preferably used, wherein the concentration of the acid in the solution is preferably selected to be higher than 30% by weight.

To prevent premature curing of the mould material mixture, the temperature during production and processing of the mould material mixture is preferably not selected too high. Also, the moulding element made from the mould material mixture should be cured as evenly as possible to achieve high stability. According to one embodiment of the method according to the invention, the moulding element is preferably cured at a temperature below 40° C., particularly in a temperature range between 15 and 30° C.

In the method according to the invention for producing cores and moulds for the foundry industry, a mould material mixture is used that is particularly suitable for manufacturing large casting moulds, wherein these casting moulds show lower emissions of harmful compounds, particularly BTX and sulphurous compounds, during casting. The object of the invention is therefore also a mould material mixture for producing casting moulds, wherein the mould material mixture comprises at least:

- a flowable fire-resistant primary moulding material;
- a curing agent, comprising a mixture of methane sulfonic acid and at least one additional sulphur-free acid; and
- an acid-curable binder.

The components of the mould material mixture and preferred embodiments have been explained in the description of the method. Reference is therefore made to the corresponding passages.

The invention further relates to moulds and cores such as are obtained using the method according to the invention, and use thereof for metal casting, particularly iron and steel casting.

The invention will be explained in greater detail in the following with reference to examples.

EXAMPLE 1

In each case 100 parts by weight H 32 quartz sand (Quarzwerke Frechen, DE) were mixed in a mixer with 0.4 parts by weight curing agent. To ensure that the curing agent was distributed evenly, mixing was carried out for one minute. Then, 1.0 part by weight furan resin was added and mixing continued for a further minute. A tubular casting mould, open at the top and having a base was produced in the nature of a sample item from the mould mixing material thus obtained. The casting mould had a wall thickness of 5 cm, an internal diameter of 5 cm, and a height of 30 cm. The composition of the mould mixing materials examined is summarised in table 1.

TABLE 1

Composition of mould mixing materials

| | Mould mixing material 1 (not according to invention) | Mould mixing material 2 (according to invention) |
|---|---|---|
| H 32 quartz sand | 100 GT | 100 GT |
| p-toluenesulfonic acid (aq. 65%) | 0.4 GT | — |
| Methane sulfonic acid (70%/Lactic acid (80%) = 50:50 | — | 0.4 GT |
| Furfuryl alcohol urea resin[a] | 1.0 GT | 1.0 GT |

[a]Askuran EP 3576, Ashland-Sudchemie-Kernfest GmbH, Hilden, DE

In a fume cabinet, the casting mould was filled with 4.3 kg molten iron (casting temperature: 1400° C.) such that the weight ratio between the casting mould and the molten iron was roughly 1:1. A defined partial flow was drawn off from the exhaust gas stream of the fume cabinet via a sampling probe, and the substances contained in the partial flow were adsorbed in activated charcoal using a method as defined in DIN EN 14662-2 (i.e., German (Deutsche) Industry Norm). The adsorbed substances (benzene, toluene and xylene) were analysed qualitatively and quantitatively using gas chromatography.

To determined the sulphur dioxide content, a partial stream from drawn off from the exhaust gas and sucked into a PE bag using a vacuum device. The sulphur dioxide concentration was determined by mass spectrometry.

The results are summarised in table 2.

TABLE 2

Emissions from a casting mould during casting (technical scale)

| | Mould mixing material 1 (not according to invention) | Mould mixing material 2 (according to invention) |
|---|---|---|
| Benzene [mg/m$^3$] | 6095 | 560 |
| Toluene [mg/m$^3$] | 30000 | 300 |
| Xylene [mg/m$^3$] | 930 | 105.5 |
| Sulphur dioxide [Vol-ppm] | 3600 | 1300 |

When an acid mixture of methane sulfonic acid and lactic acid is used, a significantly smaller fraction of aromatic compounds is measured in the exhaust gas stream than when p-toluene sulfonic acid is used.

EXAMPLE 2

Comparable measurement were also taken under operational conditions in an iron foundry. For this, a cast element weighing about 250 kg (casting temperature approx. 1400° C.) was produced. The ratio between the weights of the mould material mixture and the iron was approximately 4:1. The compositions of the mould material mixtures used to produce the casting mould are summarised in table 3.

TABLE 3

Compositions of the mould material mixture

| | Mould mixing material 3 (not according to invention) | Mould mixing material 4 (according to invention) |
|---|---|---|
| H 31 quartz sand | 100 GT | 100 GT |
| p-toluenesulfonic acid (aq. 65%) | 0.35 GT | — |
| Methane sulfonic acid (70%/Lactic acid (80%) = 50:50 | — | 0.35 GT |
| Furfuryl alcohol urea resin[a] | 0.80 GT | 0.80 GT |

The concentrations of benzene, toluene, xylene and sulphur dioxide were determined as described in example 1. The results are summarised in table 4.

TABLE 4

| Emissions from a casting mould when casting (practical application) | | |
|---|---|---|
| | Mould mixing material 3 (not according to invention) | Mould mixing material 4 (according to invention) |
| Benzene [mg/m$^3$] | 15.0 | 5.0 |
| Toluene [mg/m$^3$] | 18.0 | 6.0 |
| Xylene [mg/m$^3$] | <0.5 | <0.5 |
| Sulphur dioxide [Vol-ppm] | 22.5 | 19.1 |

Under practical conditions as well, a reduction in toxic emissions (BTX and sulphur dioxide) compared with the standard system (mould material mixture 3) by using the acid mixture comprising methane sulfonic acid and lactic acid (50:50) as the catalyst (mould material mixture 4).

EXAMPLE 3

In a laboratory mixer (manufactured by Vogel and Schemmann A G, Hahn, Del.), 0.4% of the curing agent listed in table 5 was first added in each case to 3 kg H32 quartz sand (Quarzwerke Frechen), followed by 1.0% by weight furfuryl alcohol-urea resin (Askuran EP 3576, Ashland-Südchemie-Kernfest GmbH, Hilden, Del.). The mixture was produced at room temperature (22° C.). The sand temperature was 21° C. After addition of each component, each sand mixture was mixed vigorously for 1 minute. Then the mould material mixture was introduced into the test rod mould by hand and compacted with a manual plate.

In order to determine the demoulding time, the mould material mixture is compacted with a manual plate in a mould 100 mm high and having a diameter of 100 mm. The surface is tested at defined time intervals with the GF surface hardness tester. When the test ball no longer sinks into the core surface, the demoulding time is recorded.

To determine the processing time with the mould material mixture, the remaining quantity of the sand mixture is evaluated visually for flowability and rolling behavior after production of the bending core. When rolling takes place in blocks, the sand processing time is terminated.

Four rectangular test rods having dimensions 220 mm×22.36 mm×22.36 mm, known as Georg-Fischer test rods, were produced.

To determine bending strengths, the test rods were inserted in a Georg-Fischer strength testing device, equipped with a three-point bending device (DISA-Industrie AG, Schaffhausen, C H), and the force required to break the test rods was measured.

Bending strengths were measured according to the following schema:

2 h after production of the mould material mixture, (cores stored at room temperature after demoulding)

4 h after production of the mould material mixture, (cores stored at room temperature after demoulding)

24 h after production of the mould material mixture, (cores stored at room temperature after demoulding).

Two test series were performed for each. The results of the strength test are summarised as the average of 2 test series in table 5.

TABLE 5

| Strength tests | | | | | | | |
|---|---|---|---|---|---|---|---|
| Sand mixture | 1 | 2 | 3 | 4 | 5 | 6 | 7 |
| Methane sulfonic acid 70% | 100% | | 50% | 50% | 50% | 50% | 50% |
| p-toluene sulfonic acid 65% | | 100% | 50% | | | | |
| Actic acid 80% | | | | 50% | | | |
| Citric acid 50% | | | | | 50% | | |
| Glycolic acid | | | | | | 50% | |
| Glyoxylic cacid | | | | | | | 50% |
| Processing time (min) | 3 | 12 | 5 | 15 | 12 | 12 | 14 |
| Demoulding time (min) | 10 | 60 | 20 | 75 | 60 | 60 | 70 |
| Bending strengths δB [N/cm$^3$] | | | | | | | |
| 2 h | 340 | 270 | 300 | 270 | 340 | 270 | 310 |
| 4 h | 350 | 315 | 340 | 440 | 445 | 390 | 330 |
| 24 h | 430 | 410 | 420 | 525 | 535 | 465 | 450 |
| | Comparison | Acc. to invention | | | Not acc. to invention | | |

The invention claimed is:

1. A method for producing cores and moulds for the foundry industry, comprising:

providing a flowable, fire-resistant primary moulding material;

applying an acid to the flowable, fire-resistant primary moulding material, to obtain an acid-coated primary moulding material;

applying a binder that is curable with an acid to the acid coated fire-resistant primary moulding material, to obtain a fire-resistant primary moulding material coated with a binder;

shaping the fire-resistant primary moulding material coated with a binder to form a moulded body; and curing the moulded body;

wherein the acid is a mixture of methane sulfonic acid and at least one further, sulphur-free acid, wherein the fraction of methane sulfonic acid in the acid is selected to be less than 70% by weight, the sulphur-free acid is an organic acid having a carboxyl group and at least one more group selected from the group consisting of carboxyl group, hydroxy group, and aldehyde group, and the organic acid has a $pK_a$ of less than 4, measured at 25° C., and the acid-binder comprises a furan-no-bake binder or a phenol-no-bake binder.

2. The method according to claim 1, wherein the organic acid is selected from the group of citric acid, glycolic acid and glyoxylic acid.

3. The method according to claim 1, wherein the acid is added in the form of an aqueous solution and the concentration of the acid in the aqueous solution is at least 30% by weight.

4. The method according to claim 1, wherein curing of the moulded body is carried out at a temperature of less than 40° C.

* * * * *